US006270398B1

(12) United States Patent
Liao

(10) Patent No.: US 6,270,398 B1
(45) Date of Patent: Aug. 7, 2001

(54) VIBRATIONAL MAGNETIC POLISHING MACHINE

(76) Inventor: Lu-Jung Liao, No. 19-23, Kuang Min Road, Si Tun Area, Taichung (TW)

( * ) Notice: Subject to any disclaimer, the term of this patent is extended or adjusted under 35 U.S.C. 154(b) by 0 days.

(21) Appl. No.: 09/680,260

(22) Filed: Oct. 5, 2000

(51) Int. Cl.[7] ..... B24B 31/00
(52) U.S. Cl. ..... 451/326; 451/327; 451/328
(58) Field of Search ..... 451/32, 326, 327, 451/328, 329, 330, 93

(56) References Cited

U.S. PATENT DOCUMENTS 5,237,778 * 8/1993 Baer ..... 451/326
5,375,377 * 12/1994 Kenton ..... 451/326
5,476,415 * 12/1995 Nishimura et al. ..... 451/326
5,611,725 * 3/1997 Imahashi ..... 451/326
5,662,516 * 9/1997 You ..... 451/32
5,733,172 * 3/1998 Nishimura et al. ..... 451/326
6,146,243 * 11/2000 Imahashi ..... 451/32

* cited by examiner

*Primary Examiner*—Derris H. Banks
(74) *Attorney, Agent, or Firm*—Browdy and Neimark

(57) ABSTRACT

A vibrational magnetic polishing machine comprises a machine frame on which a workpiece container, an action device and a rotary alternating magnetic field generator are mounted such that the workpiece container is vibrated by the action device, thereby causing the workpiece and the polishing media to jump in the container. The polishing media arc induced by the alternating magnetic field to jump so as to smooth the surface of the workpiece.

6 Claims, 4 Drawing Sheets

VIBRATIONAL MAGNETIC POLISHING MACHINE

FIELD OF THE INVENTION

The present invention relates generally to a polishing machine, and more particularly to a vibrational magnetic polishing machine for smoothing the surface of a workpiece.

BACKGROUND OF THE INVENTION

The conventional polishing machine is generally formed of a workpiece container and an actuation device. As the workpiece container is actuated by the actuation device, the polishing stones contained in the workpiece container are actuated to rub the surface of a workpiece contained in the workpiece container. Certain conventional polishing machines are provided with a plurality of magnetic media in place of the polishing stones. The magnetic media are caused by the magnetic field effect to travel randomly at a high speed to rub the surface of a workpiece.

Such conventional polishing machines as described above are defective in design in that the surface of the workpiece is susceptible to damage caused by friction of the fast-moving polishing stones or magnetic media, and that the smoothing effect of the polishing stones or magnetic media depends on the intensity of collision as well as the speed at which the polishing media travel, and further that the comer surface of the workpiece is often poorly smoothed.

SUMMARY OF THE INVENTION

The primary objective of the present invention is to provide a vibrational magnetic polishing machine which is free from the deficiencies of the conventional polishing machines described above.

The vibrational magnetic polishing machine of the present invention comprises a container, a plurality of magnetic polishing media, an action device, and a rotary alternating magnetic field generator. The workpiece and the polishing media are held in the container, which is vibrated by the action device to cause the workpiece and the polishing media to jump. The magnetic polishing media are induced by the rotary alternating magnetic field to move to rub the surface of the workpiece.

DETAILED DESCRIPTION OF THE INVENTION

Figure 1:
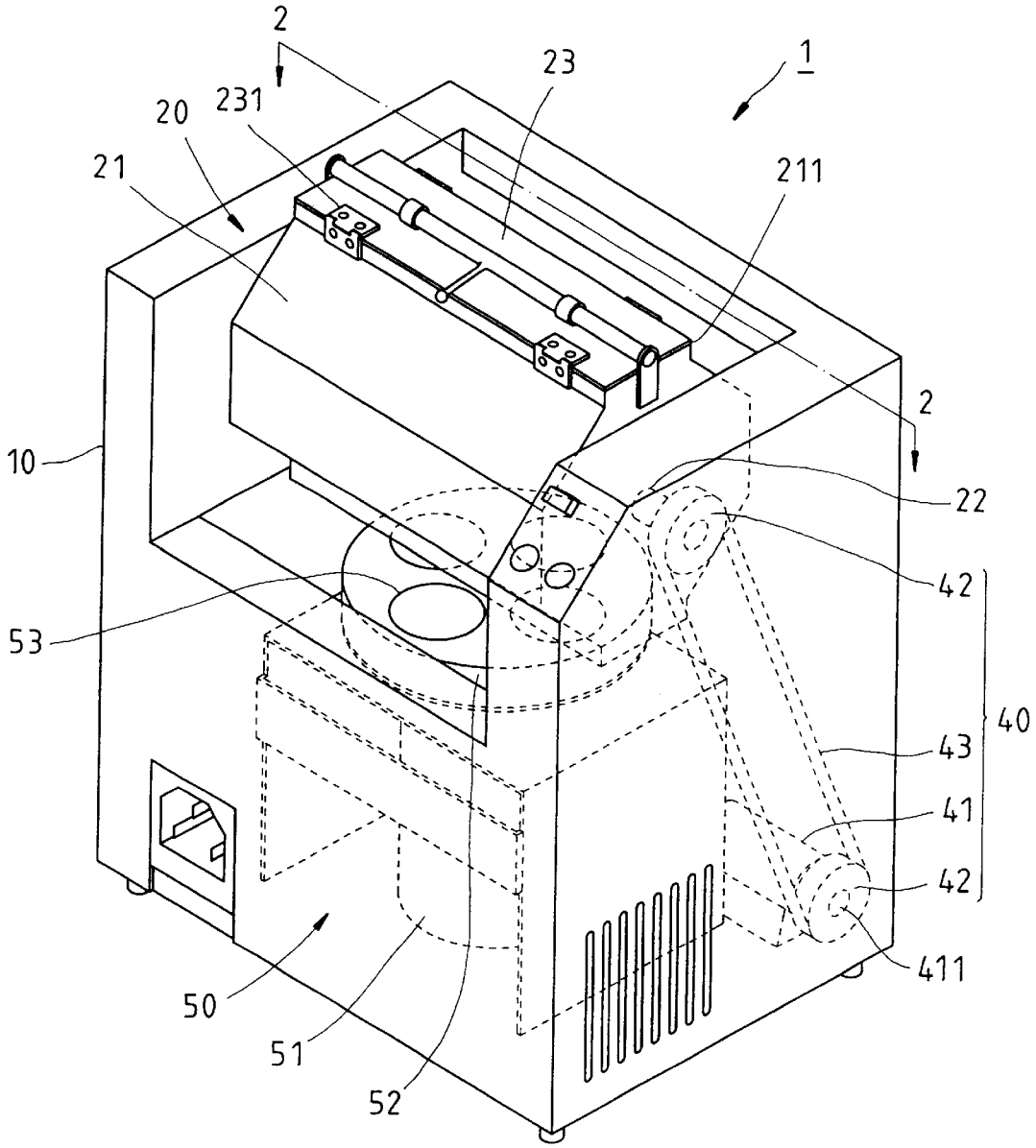
FIG. 1 shows a perspective view of a preferred embodiment of the present invention.
Figure 2:
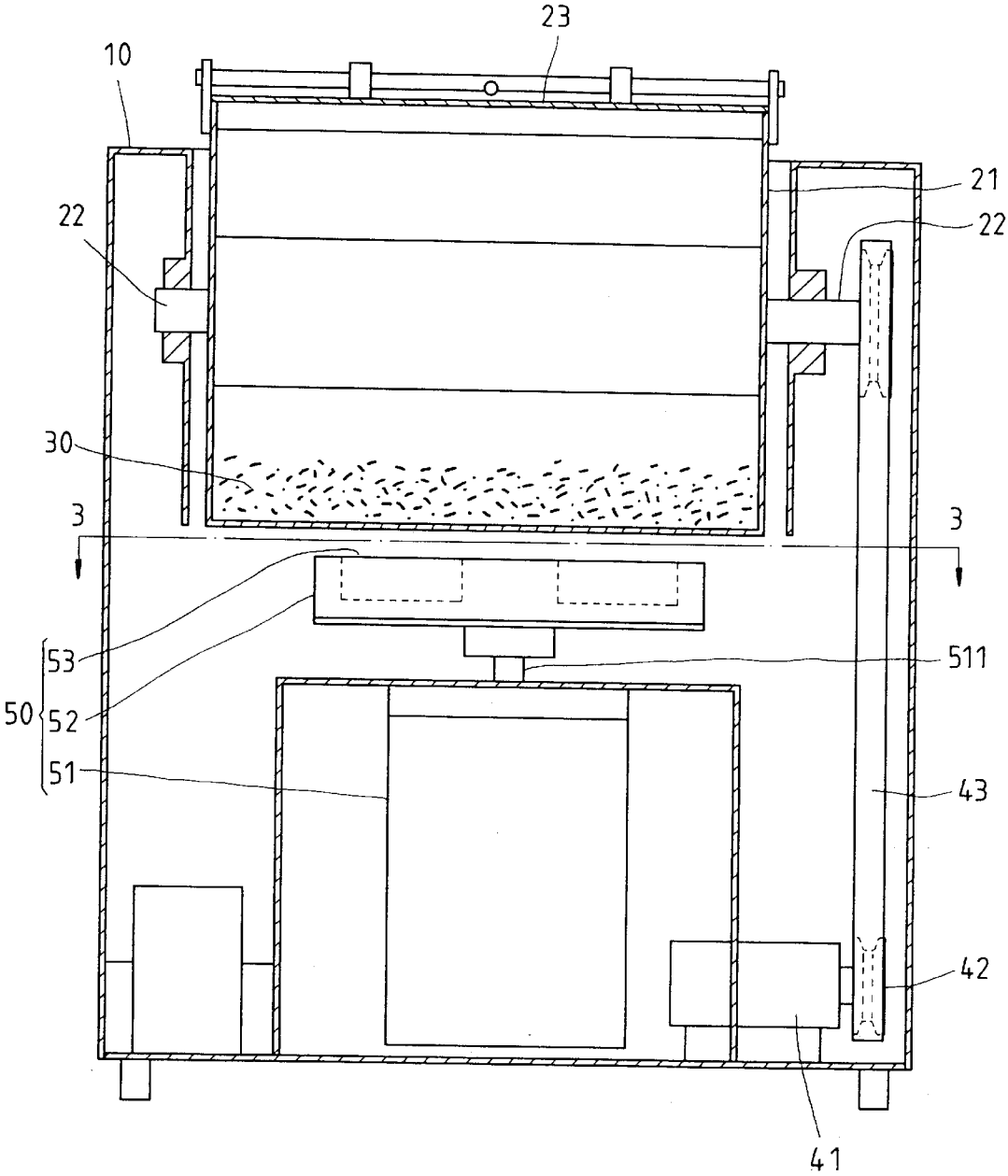
FIG. 2 shows a sectional view taken along the direction indicated by a line 2—2 as shown in FIG. 1.
Figure 3:
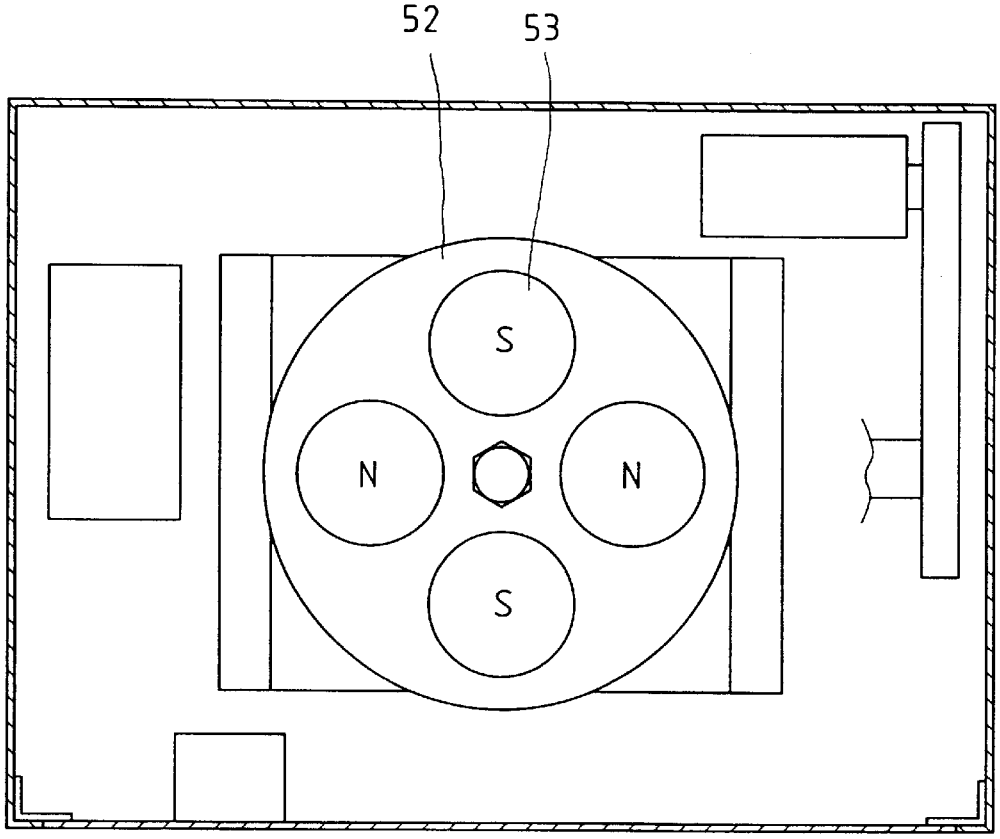
FIG. 3 shows a sectional view taken along the direction indicated by a line 3—3 as shown in FIG. 2.

As shown in FIGS. 1–3, a polishing machine 1 embodied in the present invention comprises a machine frame 10, a container 20, a plurality of polishing media 30, an action device 40, and a rotary alternating magnetic field generator 50.

The container 20 has a body 21 which is of a hexagonal cylindrical construction and is provided at both ends with a pivot 22 for pivoting the container 20 to the machine frame 10. The body 21 is provided with an opening 211 and a cover 23 which are fastened by two hinges 231 to seal off the opening 211.

The polishing media 30 are nails of stainless steel and are disposed in the container 20.

The action device 40 comprises a motor 41 mounted on the machine frame 10, and two belted wheels 42 mounted on the outer end of a motor rotor 411 such that the belted wheels 42 and the motor 41 are linked by a transmission belt 43. The body 21 of the container 20 is driven by the motor 41 to turn on the pivots 22.

The rotary alternating magnetic field generator 50 comprises a motor 51 mounted under the container 20 such that the outer end of a motor rotor 511 is located uprightly. A seat disk 52 is mounted at the center thereof with the outer end of the rotor 511 such that the seat disk 52 is opposite in location to the container 20. A plurality of permanent magnets 53 are arranged along the periphery of the seat disk 52 such that N poles and S poles of the magnets 53 are alternately arranged. As the motor 51 is started, the seat disk 52 is driven to turn to result in formation of a revolving and alternating magnetic field.

Figure 4:
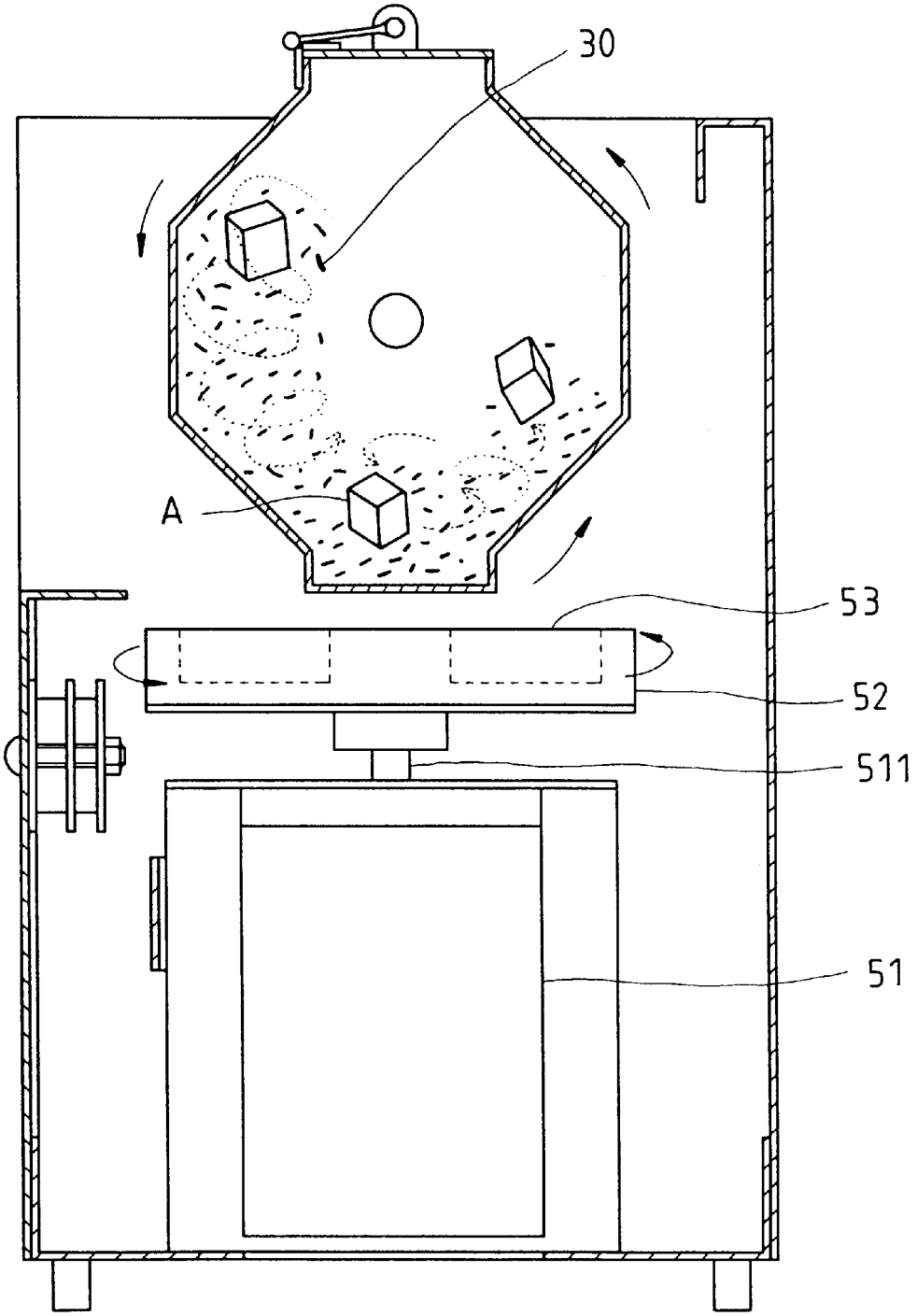
FIG. 4 shows a schematic view of the preferred embodiment of the present invention in action.

As shown in FIG. 4, a workpiece "A" is deposited in the body 21 of the container 20 via the opening 211. The container 20 is sealed off by the cover 23 before the two motors 41 and 51 are started. As the body 21 is driven to turn, the workpiece "A" and the polishing media 30 are caused to collide with one another so as to smooth the surface of the workpiece "A" by the polishing media 30. In the meantime, the stainless steel nails 30, which are contained in the body 21 of the container 20, are induced by the magnetic field brought about by the magnets 53, thereby causing the nails 30 to move and jump horizontally along the direction of the magnetic line of force. As a result, the surface of the stationary workpiece "A" is smoothed by the friction between the nails 30 and the workpiece "A".

In light of the workpiece "A" being turned by the body 21 in motion along the longitudinal direction, a thorough smoothing of the surface of the workpiece "A" is done efficiently. In addition, the rubbing of the workpiece "A" by the polishing media 30 is effected in all directions by the polishing machine 1 of the present invention.

The embodiment of the present invention described above is to be regarded in all respects as being merely illustrative and not restrictive. Accordingly, the present invention may be embodied in other specific forms without deviating from the spirit thereof. For example, the shape of the container of the present invention may be hexagonal, tetragonal, octagonal, or other geometric form. In addition, the container of the prcscnt invention may be fastened pivotally with the machine frame by other means, such as an unbalanced pivot. The workpiece may be caused to jump in the container of the present invention by a means other than the one described in the preferred embodiment of the present invention. Therefore, the present invention is to be limited only by the scopes of the following appended claims.

What is claimed is:

1. A vibrational magnetic polishing machine comprising:

a machine frame;

a container mounted on said machine frame for holding one or more workpieces;

a plurality of magnetic polishing media disposed in said container;

an action device mounted on said machine frame to vibrate said container such that the workpieces and said magnetic media are caused to jump; and a rotary alternating magnetic field generator mounted on said machine frame for generating a revolving alternating magnetic field to induce said magnetic polishing media to jump in said container.

2. The machine as defined in claim 1, wherein said container has a body which is pivoted to said machine frame by two pivots; wherein said action device comprises a motor, two belted wheels mounted respectively on a rotor of said motor and a rotary shaft of said body, and a transmission belt linking said two belted wheels whereby said belted wheels drive said body of said container to turn, so as to cause the workpieces and said magnetic polishing media to jump.

3. The machine as defined in claim 2, wherein said body is of a hexagonal cylindrical construction.

4. The machine as defined in claim 2, wherein said body is provided with an opening; wherein said container is provided with a cover fastened therewith by two hinges such that said cover is used to seal off said opening.

5. The machine as defined in claim 1, wherein said polishing media are nails of stainless steel.

6. The machine as defined in claim 1, wherein said rotary alternating magnetic field generator comprises a motor mounted under said container such that an outer end of a rotor thereof is located uprightly for mounting a seat disk opposite in location to said container, said seat disk being provided with a plurality of permanent magnets which are arranged in such a manner that N poles and S poles of said permanent magnets are arranged alternately to bring about alternating magnetic fields at such time when said seat disk is driven by said motor to turn.

* * * * *